United States Patent [19]

Swistun

[11] 4,289,079

[45] Sep. 15, 1981

[54] SAWDUST FURNACE

[76] Inventor: Gwido K. Swistun, Shadacee Rd., Saco, Me. 04072

[21] Appl. No.: 136,172

[22] Filed: Mar. 31, 1980

[51] Int. Cl.[3] ..... F23G 3/00

[52] U.S. Cl. ..... 110/255; 110/102; 110/196; 110/242; 110/251

[58] Field of Search ..... 110/102, 196, 242, 251, 110/255

[56] References Cited

U.S. PATENT DOCUMENTS

| | | | |
|---|---|---|---|
| 178,372 | 6/1876 | Kidder | 110/251 X |
| 1,536,220 | 5/1925 | Jouelard | 110/251 |
| 3,961,587 | 6/1976 | Ozawa | 110/251 X |
| 4,218,980 | 8/1980 | Probsteder | 110/196 |

FOREIGN PATENT DOCUMENTS

| | | | |
|---|---|---|---|
| 6413 | 3/1932 | Australia | 110/251 |
| 73807 | 7/1948 | Norway | 110/251 |
| 71061 | 12/1927 | Sweden | 110/251 |

*Primary Examiner*—Edward G. Favors
*Attorney, Agent, or Firm*—William Nitkin

[57] ABSTRACT

A sawdust-burning furnace comprising an inner shell, an outer shell disposed approximately 1 inch from the inner shell, a bottom member and a cover member, an air intake from the base thereof, an exhaust aperture, means to place sawdust therein with a primary channel and inverted cone-shaped burning area, and a flame deflector having legs adapted to rest upon the sawdust while burning is taking place.

6 Claims, 6 Drawing Figures

3 HRS

6 HRS

SAWDUST FURNACE

BACKGROUND OF THE INVENTION

1. Field of the Invention

The device of this invention resides in the area of sawdust-burning furnaces and more particularly relates to a furnace adapted to burn sawdust for the production of useful heat energy.

2. History of the Prior Art

At the present sawdust is a by-product of the lumber industry and is commonly found in quantity in the northern United States and Canada. Until recently sawdust has been treated as a waste product and a disposal problem. Efforts are now being made to utilize sawdust efficiently and one such use is as a fuel. Sawdust is similar to split wood as far as its ability to produce heat energy. When compared to other fuel sources, sawdust differs substancially in density as, for example, from wood and has the disadvantage of depositing heavy tar and creosote water mixtures when their condensation points are reached. A major advantage to the use of sawdust as a fuel source arises in the area of cost as sawdust is significantly less expensive than equivalent energy-producing amounts of wood or oil. It is therefore desirable that a furnace be developed that can efficiently utilize and burn sawdust in a manner that could be utilized in both industry and the home. Industrial users presently burn sawdust in the air by means of high pressure injection of the material into a furnace. Another means of burning sawdust has been by the use of conveyorized automatic feed of sawdust material to an area where it is surface burned in air. Small sawdust furnaces which are hopper-fed and surface burning have been utilized in homes. Double wall drum sawdust stoves have long been in use, mostly in other countries. These stoves use packed sawdust with a central hole for air circulation. These stoves burn well for a time, but due to the changing shape of the flue, they lose efficiency. See "Wood Waste As Fuel", leaflet No. 41, Revised June 1956, Forest Products Research Lab, Princes Risborough, Aylesbury, Bucks, England. Also see U.S.D.A. Forest Service Research Note Ne-208 on Double Drum Sawdust Stove by Jeffrey L. Wartluft. Also see Burmese Forester, 1946, page 14, "Wood Waste Utilization" by U. Win Maung. Also see Fulgora, Slow Combustion Stove, Great Britain, No. 595,869. Also see Sawdust Stove Photo Story, No. 30, Northeast Forest Experimentation Station, Upper Darby, PA. Also see U.S.D.A. Forest Service Memo of Mar. 6, 1980 on Chilean Sawdust Stoves. The usual problem, however, with surface, drum, or injection burning of sawdust as discussed above resides in the lack of uniformity of the sawdust particles, their varying moisture content, distillate deposits, and the presence of chips of wood mixed therein which cause significant problems with the uniformity and rate of burning and result in low burning efficiency.

SUMMARY OF THE INVENTION

It is an object of this invention to provide an efficient and commercially usable sawdust-burning furnace which can in its various embodiments be used by industry and also by domestic users. The furnace is provided with cylindrical inner and outer shells concentrically placed approximately 1 inch apart having a closed bottom with air intake means at its base for providing air to travel both between the inner and outer shells and into the inside of the inner shell through a firebox member. The sawdust is placed within the inner shell and formed around forming pipes which when removed form a vertical channel extending down to the horizontal channel through the firebox and out of the bleeder tube through to the air intake means. The top of the sawdust is formed as an inverted cone with walls at approximately 45° from the forming tube extending upwards to the inside of the inner shell. A top cover is provided which covers both the inner and outer shells and contains a thermometer means and can have an inspection widow thereon. The cover includes bushing means for sliding a suspension rod in vertical alignment therewith which rod is movable up and down. At the base of this rod is a circular platelike flame deflector which has a castiron disk affixed below it and at least three and preferably four stabilization legs which are adapted to rest upon the upper edge of the sawdust. The firebox below is provided as an air connector to the bleeder tube through which the horizontal channels in the sawdust extend. The air intake means may be comprised of a blower or other air-providing means and has an adjustment means such as a damper described below associated therewith. The air intake means has a portion thereof which opens and allows access to the bleeder tube which extends into the firebox for ignition of the sawdust. Within the outer shell located approximately two-thirds up from the base is an aperture for connection with a flue which is adapted to connect to a chimney for the escape of gases. In practice one would load the inner shell with sawdust and pound it with a mallet into position around the vertically positioned forming pipe whose diameter is the diameter of the desired primary air channel. A second forming pipe is horizontally positioned to make a channel when removed so that the air may reach this primary channel from the air intake means. This pipe would extend out the air intake means of the furnace as described in further detail below. The fire is ignited by inserting some combustible material such as a rolled-up newspaper into the bleeder tube to ignite the sawdust along the primary channel, burning substantially along the areas where the primary channel opens up to a 45° angle beneath the flame deflector. The flame deflector, of course, increases significantly in temperature, and the heat is carried over the top of the inner shell whose height is about 2 inches lower than the outer channel and is picked up by the secondary air circulation caused by a series of air jets in the bleeder tube positioned between the inner and outer shells. The secondary air circulation is provided to run between the inner and outer shells and out the flue connector up the chimney. This secondary air circulation in turn assists in creating a circulation to carry the primary air also in the same direction. It is important as is done herein that sufficient air circulation be provided. As the fire burns, the sawdust slowly collapses in on itself and the flame deflector moves downward guided by its suspension rod and falls slowly over a period of hours to the bottom of the furnace. It has been found that a structure of this invention allows for substantially complete combustion of the sawdust leaving only a small residue as will be described below when illustrated herein.

The furnace of this invention can be provided in a variety of sizes, both large and small for home use, room use, or larger industrial use. The sawdust may be mixed with other materials to improve combustion. For example, when the sawdust-burning furnace of this invention is used by chicken farmers, the sawdust may be mixed with chicken excrement which addition will increase its combustability as well as dispose of unwanted chicken excrement while providing heat to the chicken houses.

DESCRIPTION OF THE PREFERRED EMBODIMENT(S)

Figure 1:
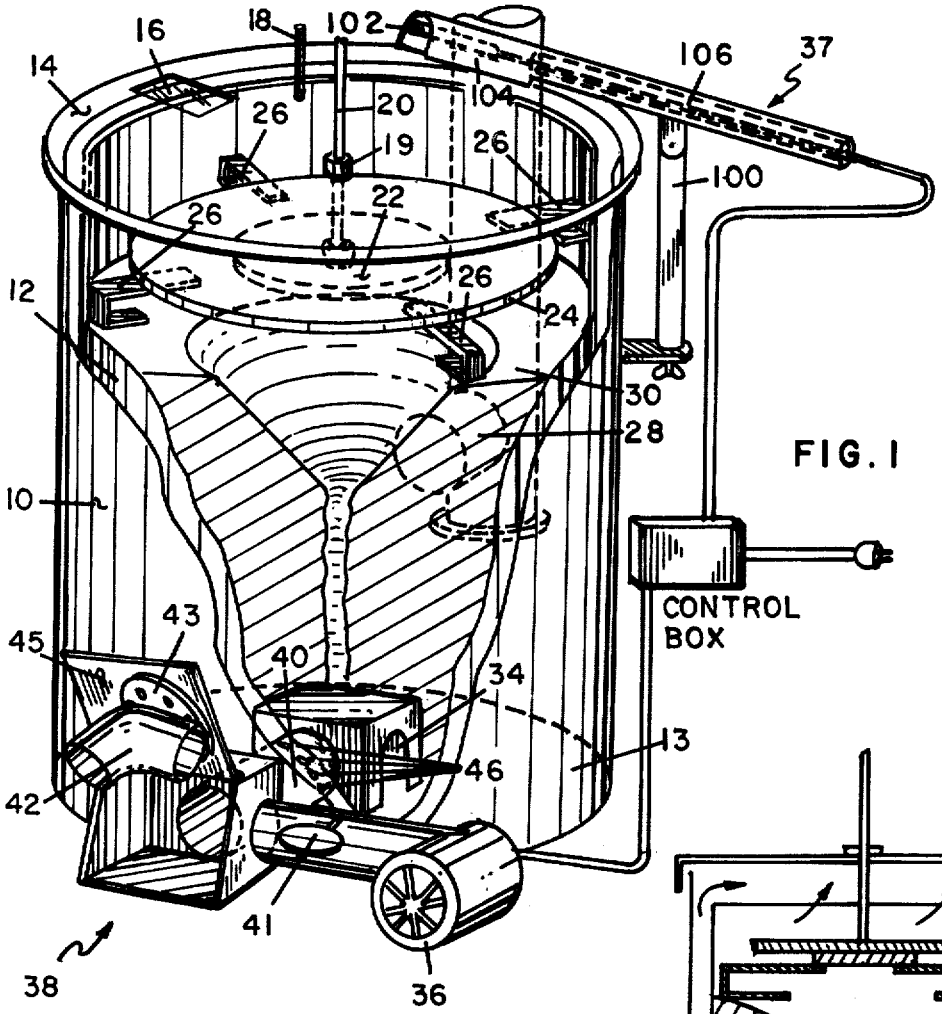
FIG. 1 illustrates a view of this invention with a cross-section thereof cut away to expose the interior.

FIG. 1 illustrates a cutaway view of the furnace of this invention showing outer shell 10 and inner shell 12 which are spaced apart from one another approximately 1 inch, the inner shell's top being somewhat lower than the top of the outer shell. An airtight cover 14 is provided which fits over the outer shell. An airtight bottom 13 is also provided. Inspection window 16 can be provided in the cover as well as thermometer means 18 which can be a magnetically attachable thermometer. Within a central portion of cover 14 is bushing 19 through which extends suspension rod 20 which is connected at its bottom to flame deflector 22 which is substantially circular and has a somewhat smaller diameter than the diameter of the inner shell. At the bottom of the flame deflector is a castiron disk 24. Affixed to the perimeter of flame deflector 22 are a series of stabilization legs 26. These legs are adapted to rest upon the sawdust surface as will be described below. Defined on the outer shell is an aperture positioned two-thirds of its height up from the bottom which is to be interconnected to flue connector 28 which may extend to a chimney pipe 30. At the base of the inner and outer shells is an air intake assembly 38. This is composed of a firebox 34 located inside inner shell 12 which has a series of openings defined therein for the air to circulate out of and is connected by means of a bleeder tube 40 to the outer portion of the air intake assembly. The bleeder tube 40 has defined therein a series of apertures forming air vents 46 located between inner shell 12 and outer shell 10. The bleeder tube extends to the outside of outer shell 10 to an air regulator mechanism which may utilize a damper control 41 or a circular aperture air entry control 43 which adjusts the amount of air entering by rotating a circular disk with apertures in it so that more or less of the apertures are exposed for the volume-adjustable entry of air therethrough. Elbow pipe 42 when lid 45 is closed interconnects air intake means from, for example, blower 36 to the bleeder tube 40. When one wishes to ignite a fire, one raises lid 45 and inserts an ignited piece of paper through bleeder tube 40 into firebox 34 which flame, due to the air circulation, is carried up the primary channel in the center of the sawdust, igniting the sawdust primarily in the area where it is shaped like an inverted cone and creating a flame which washes over the angle at the top of the primary channel and burns the sawdust on that surface.

Figure 5:
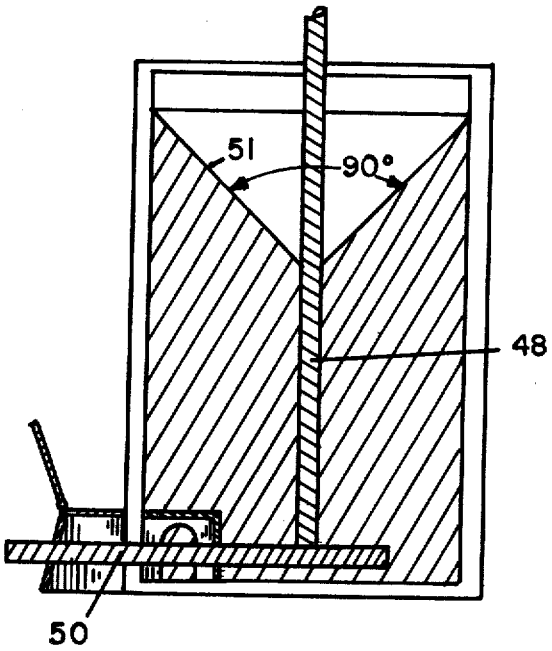
FIG. 5 illustrates the forming pipes in position for packing of the sawdust.

FIG. 5 shows the process of initially loading the furnace. One first inserts forming pipes 48 and 50, with forming pipe 48 inserted through the open top and held in place by a removable bracket, and forming pipe 50 inserted through the bleeder tube 40 in a manner so that they make contact. One then dumps sawdust into the inner shell and packs it in with a mallet while leaving an open area in the shape of an inverted cone 51 around forming pipe 48. One then removes both forming pipes 48 and 50, replaces the flame deflector and the cover and ignites the fire by inserting some combustible material such as a rolled-up newspaper through the bleeder tube 40 into the firebox 34.

Figure 2:
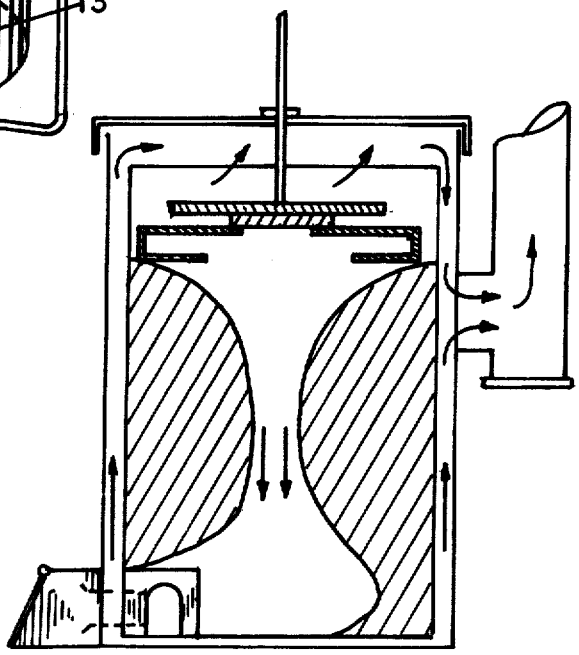
FIG. 2 illustrates a view of the device of this invention during combustion of the sawdust therein.
Figure 3:
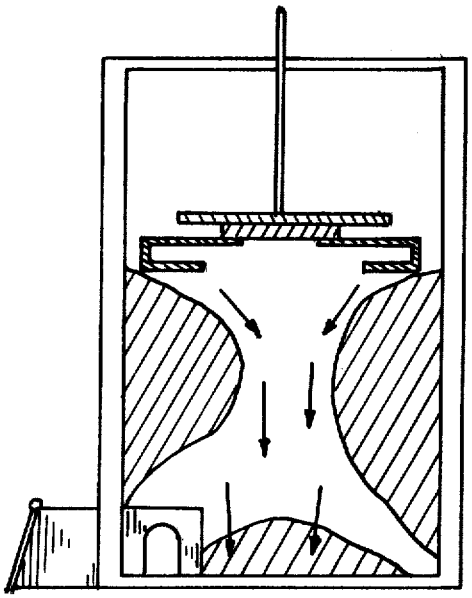
FIG. 3 illustrates a still later view of the burning process.
Figure 4:
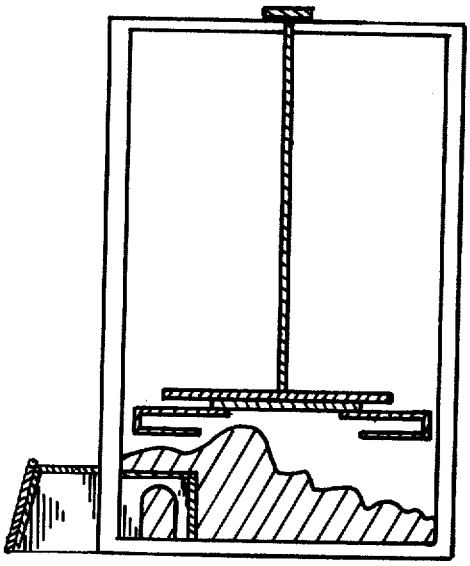
FIG. 4 illustrates a view of the burning process at the end of the burning cycle.

FIGS. 2, 3, and 4 illustrates views of the sawdust being consumed by the flame. FIG. 2 shows a view of the sawdust after approximately three hours of burning illustrating the type of cavity formed therein. After six hours the flame deflector 22 has dropped further as seen in FIG. 3. The enlargement of the inner channels weakens the walls, and most of the burning at this point occurs on the bottom. During the ninth through twelfth hours all of the burning occurs on the bottom and the flame deflector has dropped substantially as seen in FIG. 4.

Blower 36 is optional and the air intake assemble may be connected to any source of air. Having a blower member helps to increase the control over the system as it may be connected to a temperature sensor located elsewhere within the furnace to operate upon demand if the temperature should fall below a certain level. The increased volume of air supplied by the blower will of course increase the rate of combustion within the primary channel. The inner and outer shells 10 and 12, cover 14 and bottom 13 can be constructed of sheet metal as can most of the other parts of the furnace except for the castiron disk which is part of the flame deflector. This castiron construction is necessary for protection of the flame deflector due to the extremely high carbonizing temperatures which are formed within the combustion area of the furnace which might otherwise damage the flame deflector. Firebox 34 is essentially a heavy metal bridge which straddles the bleeder tube and prevents the smothering of the air inlet by falling sawdust in the latter stages of the burning cycle. The air bleeds through air vents 46 between the inner and outer shells travels around the inner shell upwards toward the cover and the flue. The circulation of this air helps in the drafting of the hot air in the furnace into the flue, mixes with the hot gases at the top and helps to induce a secondary burning if there is extensive flaming. This air circulation further helps ignition by bypassing some hot air into the flue and keeps the air in the primary channel and burning area circulating. Since the flame deflector receives the full impact of the burning, it gets red-hot and radiates heat toward the cover while the hot gases travel over the edge of the inner shell and downwards toward the flue due to the secondary air circulation which helps transfer heat to the outer shell. The heat from the outer shell is radiated in the infrared and can be channeled by duct work to where needed. Blower 36 can be controlled by an infrared sensor 37 seen in FIG. 1. Sensor 37 can be attached by support means 100 so that it is held above stove cover 14 in a manner where it can be swung away if desired for higher cycling temperature and loading. Sensor 37 can include a black bimetallic limit switch 102 held within reflector 104 positioned at the upper end of tube 106 which drafts cooler air from the side of the stove to help cool switch 102 after it reaches a high limit. This process makes the switch more sensitive.

Figure 6:
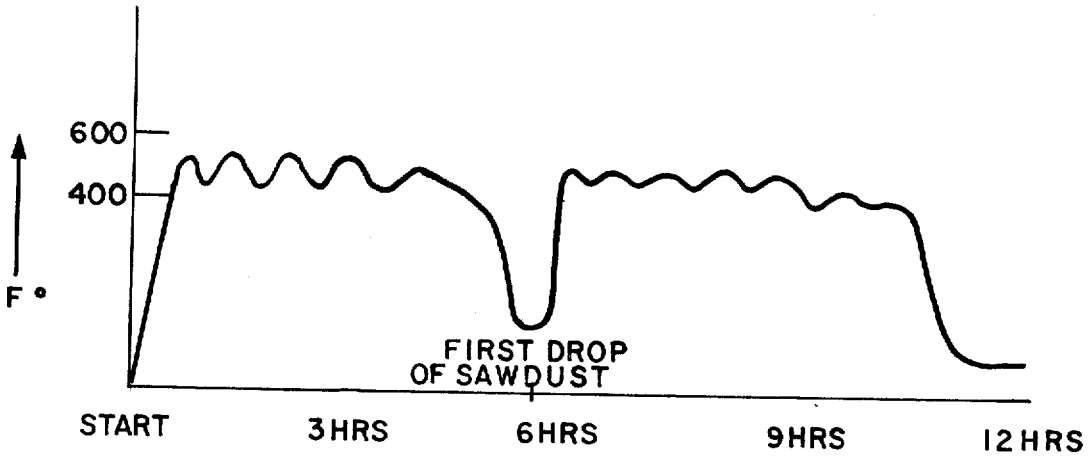
FIG. 6 shows a graph illustrating the temperature gradient during the various cycles of the heating within the furnace.

FIG. 6 illustrates the temperature gradient during the various cycles of heating as seen illustrated in FIGS. 2–4.

Although the present invention has been described with reference to particular embodiments, it will be apparent to those skilled in the art that variations and modifications can be substituted therefor without departing from the principles and spirit of the invention.

I claim:

1. An improved sawdust-burning furnace of the type having an inner shell, an outer shell disposed concentrically around said inner shell, further being slightly higher than said inner shell, a bottom member closing said outer shell at the base thereof, a cover member adapted to cover said outer shell and inner shell in which sawdust is packed having a vertical channel and a lower horizontal channel interconnected therewith and an exhaust aperture defined in said outer shell adapted for interconnection to a flue connector, wherein the improvements comprise:

said cover having an aperture defined in a central portion thereof;

a suspension rod adapted to slidably be inserted through said cover member aperture;

a flame deflector adapted to be interconnected to the base of said suspension rod, said flame deflector including support means adapted to rest upon sawdust placed in said furnace;

air intake means including a firebox disposed inside said inner shell, a bleeder tube interconnecting said firebox through the walls of said inner and outer shells to the outside of said outer shell having air vent means also disposed between said inner and outer shells; and means to provide air to said bleeder tube.

2. The apparatus of claim 1 further including blower means to provide air to said air intake means and air regulator means to control the amount of air taken into said air intake means.

3. The apparatus of claim 2 further including a hinged lid on said air intake means with an attached elbow pipe for interconnecting said bleeder tube to said air intake means.

4. The apparatus of claim 3 further including infrared heat sensing means to control the operation of said blower means.

5. The apparatus of claim 1 or 2 further including sawdust-forming means so that the top of said vertical channel is formed as an inverted cone with sides extending toward the walls of said inner shell at approximately 45° to said vertical channel.

6. The apparatus of claim 4 further including means to draft cool air over the switch of said infrared heat sensing means to quickly sensitize it after it reaches a high limit.

* * * * *